US006126237A

United States Patent [19]

Ritterhouse

[11] Patent Number: 6,126,237

[45] Date of Patent: Oct. 3, 2000

[54] ADJUSTABLE CUSHIONED HEADREST

[76] Inventor: Keith I. Ritterhouse, 954 Mercer Cir., Bullhead City, Ariz. 86429

[21] Appl. No.: 09/286,410

[22] Filed: Apr. 5, 1999

Related U.S. Application Data

[60] Provisional application No. 60/080,819, Apr. 6, 1998.

[51] Int. Cl.[7] ..... A47C 1/10

[52] U.S. Cl. ..... 297/397; 24/115 G; 297/410

[58] Field of Search ..... 297/410, 391, 297/463.1, 463.2, 397; 211/117; 248/320; 24/115 G, 115 H, 136 R

[56] References Cited

U.S. PATENT DOCUMENTS

| | | | |
|---|---|---|---|
| 2,557,874 | 6/1951 | Kailenta | 297/397 |
| 2,756,809 | 7/1956 | Endresen . | |
| 2,815,798 | 12/1957 | Lohans . | |
| 2,843,195 | 7/1958 | Barvaeus . | |
| 3,195,953 | 7/1965 | Zacks | 297/410 |
| 3,279,849 | 10/1966 | Radke et al. . | |
| 3,321,241 | 5/1967 | Froelich . | |
| 3,331,630 | 7/1967 | Harsh . | |
| 3,348,880 | 10/1967 | Swann . | |
| 3,446,531 | 5/1969 | Froelich . | |
| 4,154,478 | 5/1979 | Cohune | 297/397 |
| 5,275,463 | 1/1994 | Rocha . | |
| 5,297,304 | 3/1994 | O'Sullivan | 297/397 X |
| 5,345,627 | 9/1994 | Cammarata . | |
| 5,345,633 | 9/1994 | Harnish . | |
| 5,441,789 | 8/1995 | Walker . | |
| 5,503,456 | 4/1996 | Rossini . | |
| 5,544,378 | 8/1996 | Chow . | |
| 5,697,128 | 12/1997 | Peregrine | 24/115 H X |
| 5,799,344 | 9/1998 | Najar | 297/397 X |

OTHER PUBLICATIONS

International Publication No. WO 91/11334; Peter Dohlus, inventor; Writing or Drawing Crayon With a Shaft Consisting of a Surround Made of Material in Sheet or Foil Form and Process for Making It; Publication Date: Aug. 8, 1991.

*Primary Examiner*—Peter M. Cuomo
*Assistant Examiner*—Stephen Vu
*Attorney, Agent, or Firm*—Elizabeth A. Dawn; Richard G. Harrer; Tyson Y. Winarski

[57] ABSTRACT

An adjustable assembly for securing a cushion in a plurality of positions on the seat back of a lawn chair. In a preferred embodiment, two adjustable assemblies are used to secure a cushion to the seat back. One assembly is secured to each side of the seat back.

5 Claims, 3 Drawing Sheets

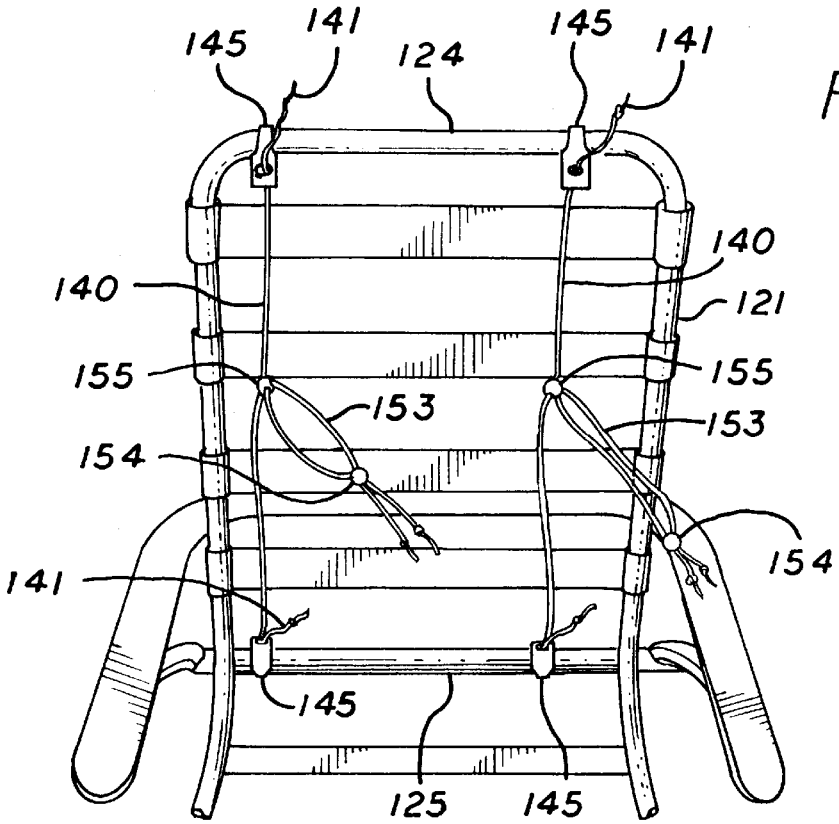
FIG. 4
FIG. 5
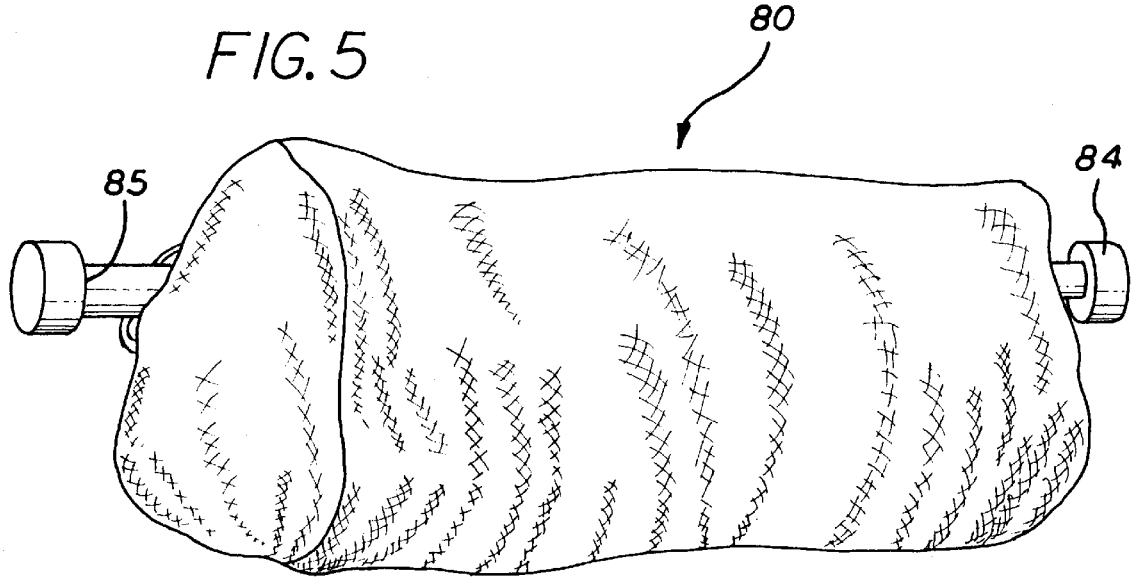

ADJUSTABLE CUSHIONED HEADREST

This Non-Provisional Application claims the benefit of U.S. Provisional Application Ser. No. 60/080,819 filed on Apr. 6, 1998.

FIELD OF THE INVENTION

This invention relates to a headrest cushion, and more particularly to an adjustable cushioned headrest designed for receiving different sized cushions and attaching them to the seat back of an outdoor chair in various positions.

BACKGROUND OF THE INVENTION

Headrest cushions are well-known and exist in many varieties. The goal in improvements of these devices and their systems is to make an apparatus that is comfortable, relatively easy to maintain and operate, and inexpensive to manufacture. A few examples of headrest cushions that exist in the art include: Harnish, U.S. Pat. No. 5,345,633, which discloses a cushion for supporting a person's neck that can be detachably secured to a seat back of an automobile or other vehicle by a pair of straps; Rossini, U.S. Pat. No. 5,503,456, which discloses a pillow comprising an insert and a case which can be secured to the back of a lawn chair with three stretchable straps; and Chow, U.S. Pat. No. 5,544,378, which discloses an inflatable pillow provided with strap means to secure the assembly to a back rest. The adjustable cushioned headrest of my invention adds to this art through a novel method of securing the cushion to a seat back in such a manner that the position of the cushion may be adjusted vertically while the assembly is secured to the seat back. My invention adds further to the art through its novel means of adjusting the size of the cushion receiving means thereby enabling the assembly to easily receive different sized cushions.

BRIEF SUMMARY OF THE INVENTION

The primary object of this invention is to provide an adjustable assembly for securing a cushion to a lawn chair seat back. A further object of the invention is to provide an adjustable assembly which can easily receive different sizes of cushions. The adjustable assembly includes means for attaching it to a seat back, means for vertical adjustment, and means for receiving cushions. The means for vertical adjustment connects the means for receiving cushions to the means for attaching the adjustable assembly to the seat back. The adjustable assembly further includes means for receiving cushions of differing sizes. This feature is important as it enables the assembly to be used in conjunction with different sizes and types of cushions, thus broadening the usefulness of the adjustable assembly.

An additional object of the invention is to provide a headrest device that will remain visually attractive and easy to use even while being exposed to the weather. In a preferred embodiment of the invention, the means for attaching the adjustable assembly to a lawn chair includes a flexible cord made of either natural or artificial fibers. In an alternative embodiment, a thin flexible metal cable can be employed as a flexible cord. There are two preferred methods for securing the cord to the seat back. In one method, the cord encircles the seat back and is secured by knotting the free-ends of the flexible cord together. In an alternative embodiment, one free end of the cord is secured to the top of the seat back with the other free-end secured to the bottom of the seat back. The free ends can be secured to the top or bottom seat back by tying the free-ends or using fasteners, such as Velcro® strips. The cord serves as a track upon which the cushion, secured by the means for receiving the cushion, slides via the means for changing the vertical position.

The preferred embodiment of the means for receiving cushions is a cord of the same type as used for the means for attaching the assembly to a chair. The cushion receiving cord is formed into a continuous loop of adjustable size by knotting the free ends of the cord together. Alternatively, the continuous loop may be formed by using a slidable locking fastener. By changing the size of the loop formed by the cord, different sizes of cushions can be accommodated. The cord secures a cushion by encircling the cushion and can then be tightened around the cushion by adjusting the locking fastener.

Preferably, the means for changing the vertical position of the cushion along the seat back comprises a locking fastener. This locking fastener is operatively engaged with the cord that secures the assembly to the seat back. The cord secured to the seat back serves as a track along which the locking fastener slides. The cord means for receiving a cushion also passes through the fastener means for changing the vertical position of the cushion such that by moving the means for changing the vertical position of the cushion the vertical location of the cushion is altered.

In a preferred embodiment, two adjustable assemblies are used to secure a cushion to the seat back with one assembly being secured to each side of the seat back. The cushion is secured on each side by the means for receiving the cushion included in each assembly. The position of the cushion can then be altered through use of the means for changing the vertical position of the cushion provided in each assembly.

BRIEF DESCRIPTION OF THE DRAWINGS

FIG. 4 is a perspective view of an alternate embodiment of the adjustable assembly mounted to the back of a lounge chair.

FIG. 5 is a front view of a case for a cushion which is optionally attached to the adjustable assembly.

DETAILED DESCRIPTION OF THE PREFERRED EMBODIMENTS

Figure 1:
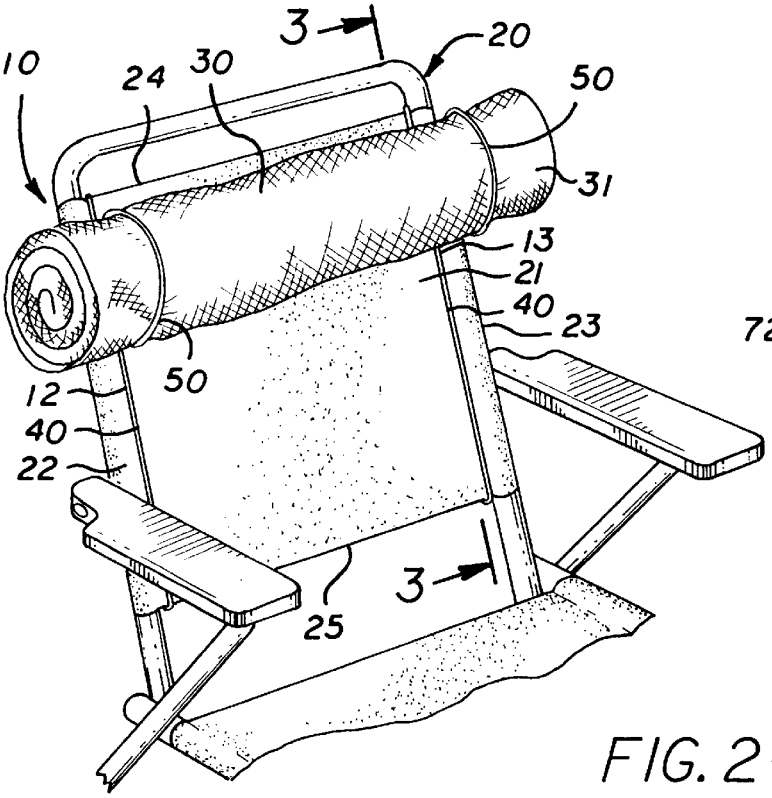
FIG. 1 is a perspective view of the preferred embodiment secured to the seat back of a lawn chair.
Figure 2:
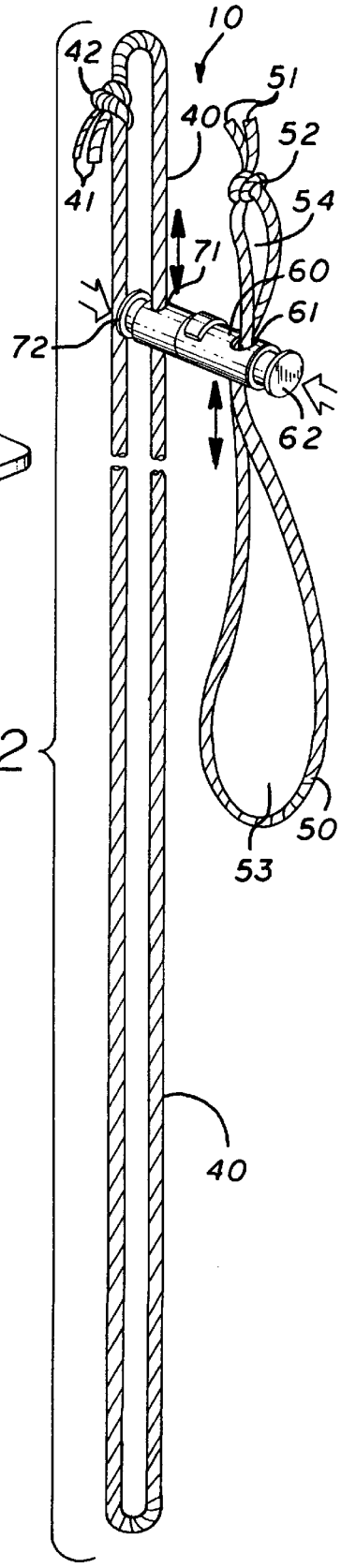
FIG. 2 is a perspective view of one adjustable assembly.
Figure 3:
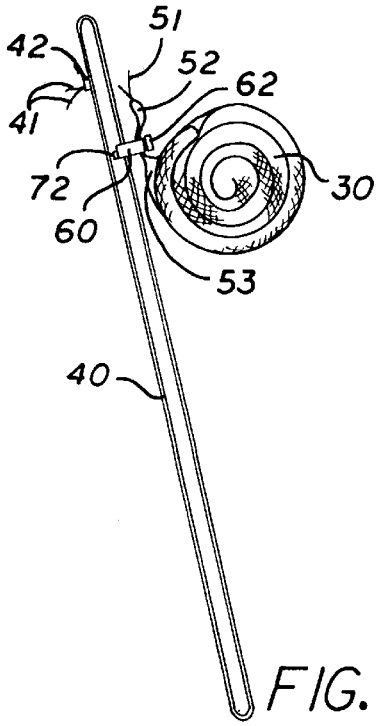
FIG. 3 is a sectional view taken on the line 3—3 of FIG. 1.

FIGS. 1, 2, and 3 show one embodiment of the invention. In FIG. 1, the adjustable assembly 10 is secured to the seat back 21 of a lawn chair 20. A rolled up towel serves as a cushion 30 and is secured by a pair of adjustable assemblies 10 on either side of seat back 21. Cushion 30 is secured at its ends 31 by means of flexible cords 50.

FIG. 2 is a more detailed view of one adjustable assembly 10. Cord 40 functions to secure the assembly 10 to seat back 21. Cord 40 is formed into a continuous loop by having its free-ends 41 tied into a knot 42. To secure the cord 40 to the seat back 21, the cord encircles the seat back 21 and then has free-ends 41 tied in a knot 42. The use of cord 40, the ends of which are tied together to form a continuous loop, enables the device to be sized to fit seat backs of varying dimensions.

Cord 50 secures the cushion 30 to the assembly 10. Cord 50 is formed into a continuous loop by tying free-ends 51 into a knot 52. Cord 50 passes through an opening 61 in locking fastener 60 and is then held in a fixed position. After passing through the locking fastener 60, cord 50 is divided into two loops 53 and 54. Cushion 30 is secured in loop 53. Loop 54 performs no function. By pushing button 62 provided in locking fastener 60, cord 50 can pass through opening 61 allowing the adjustment of the size of the loop 53 in which the cushion 30 is secured. Altering the size of the loop 53 enables different sizes of cushions 30 to be secured by assembly 10. Once the cushion 30 is placed in loop 53, the loop can be constricted by appropriately adjusting locking fastener 60. Cord-lock fasteners, such as locking fastener 60, are available in a variety of styles from American Cord and Webbing and Velcro USA.

As shown best in FIG. 2, locking fastener 60 is provided with openings 61 and 71 and push buttons 62 and 72. As earlier noted, cord 50 passes through opening 61. The size of cord loop 53 is easily changed by pressing on button 62 which allows loop 53 to be enlarged or reduced in size. In a similar manner, cord 40 passes through opening 71 of fastener 60, and pressing on button 72 allows fastener 60 to move up and down the length of cord 40, thus this portion of cord 40 serves as a track for adjusting the vertical placement of cushion 30.

As shown in FIG. 3, cushion 30, which is a rolled up towel, is secured in loop 53 of cord 50. The size of loop 53 is easily controlled by locking fastener 60. Cord 40 secures assembly 10 to the seat back 21.

In an alternative embodiment, shown in FIG. 4, the free-ends 141 of cord 140 can be secured to the top 124 and bottom 125 frame members of seat back 121 by fasteners 145. In the embodiment presently preferred, fasteners 145 are Velcro® strips which are used to attach ends 141 to seat back 121. Similarly to the embodiment of the invention described in FIGS. 1–3 above, cord 140 serves as a track for adjusting the vertical placement of cushion receiving means 153. I employ a cord lock 155 as a means to adjust the vertical placement of cushion receiving means 153. Cushion receiving means 153 may be adjusted to accommodate a variety of cushion sizes through use of cord lock 154, which functions in a manner similar to that of fastener 60.

Figure 6:
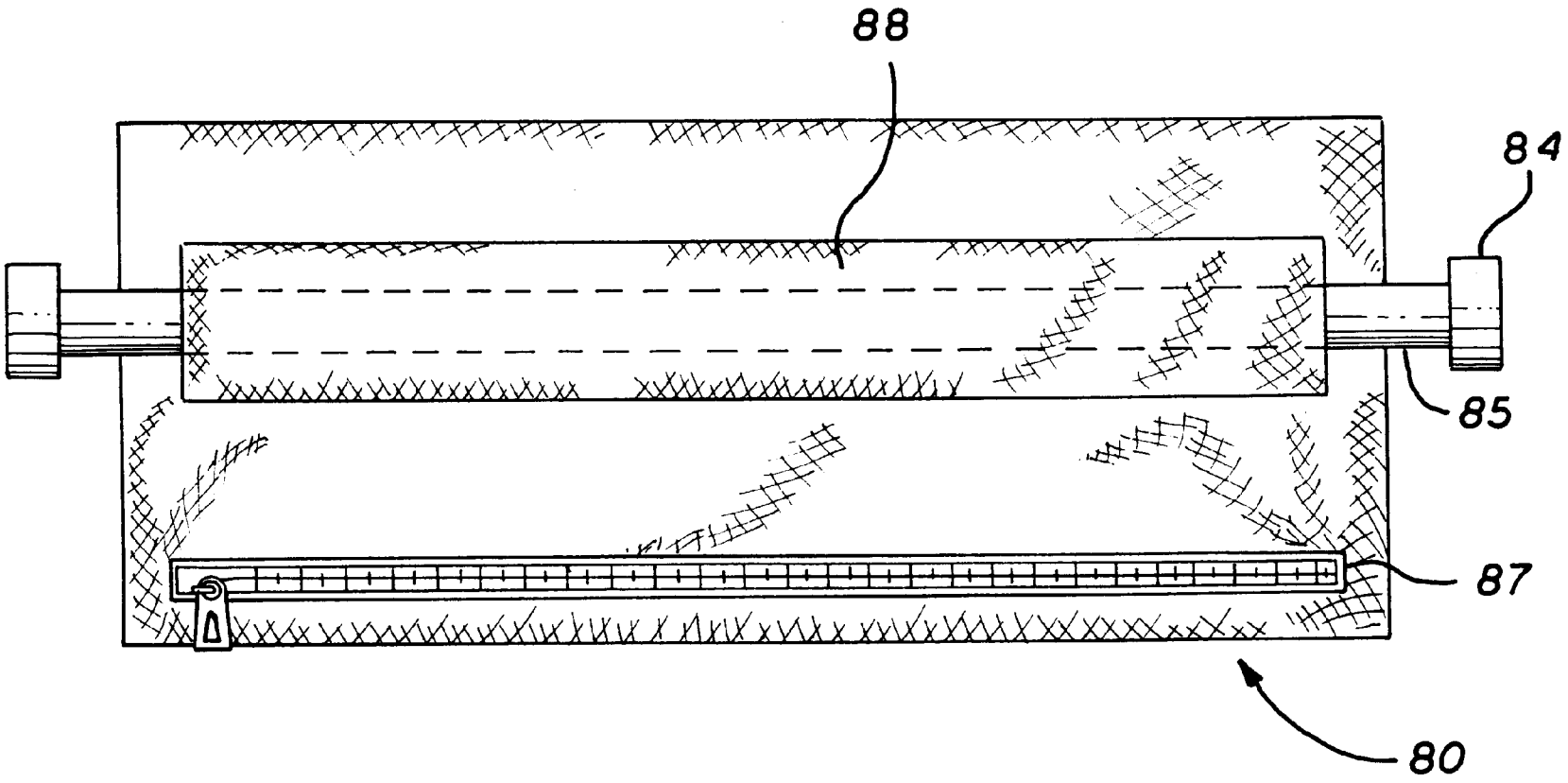
FIG. 6 is a rear view of the case shown in FIG. 5.

FIGS. 5 and 6 show case 80 which may be used in connection with the adjustable cushioned headrest assembly of the present invention. As shown in FIG. 6, case 80 is provided with zippered opening 87 for insertion and removal of cushioning material. Case 80 may be stuffed with a pillow of synthetic fibers or other suitable material. Alternatively, a towel may be inserted through opening 87 and used as cushioning material. Case 80 is provided with sleeve 88 for insertion of rod 85. Rod 85 extends beyond the ends of case 80 so that the ends 84 of rod 85 may be attached to the adjustable assembly 10 by tightening each of loops 53 and 153 about ends 84.

I claim:

1. An adjustable assembly for securing a cushion in a variety of positions on a seat back, said assembly comprising:

a. means for attaching said assembly to said seat back;

b. cushion receiving means which encircle a cushion, said cushion receiving means also provided with means for adjusting the size of said cushion receiving means thereby enabling said cushion receiving means to receive a variety of different sized cushions; and c. positioning means connecting said attaching means to said cushion receiving means whereby the vertical position of said cushion receiving means may be adjusted.

2. The adjustable assembly of claim 1, wherein said attaching means comprises a flexible cord having free-ends attached to each other thereby encircling around said seat back and securing said adjustable assembly to said seat back.

3. The adjustable assembly of claim 1, wherein said attaching means comprises a flexible cord having free-ends, one free-end being attached to a top portion of said seat back and another free-end being attached to a bottom portion of said seat back, thereby securing said adjustable assembly to said seat back.

4. The adjustable assembly of claim 1, wherein said cushion receiving means comprises a flexible cord encircling said cushion thereby securing said cushion to said adjustable assembly.

5. The adjustable assembly of claim 4, wherein said size adjusting means comprises a locking fastener which engages said flexible cord encircling said cushion, whereby adjusting said locking fastener alters the length of said flexible cord thereby enabling the cushion receiving means to secure different sized cushions.

* * * * *